US010089828B2

(12) United States Patent
Nelson et al.

(10) Patent No.: US 10,089,828 B2
(45) **Date of Patent: *Oct. 2, 2018**

(54) GAMING SYSTEM AND METHOD ENABLING A PLAYER TO EARN A PLAY OF A BONUS GAME USING ONE DEVICE AND TO REDEEM THE EARNED PLAY FOR AN ENHANCED PLAY OF THE BONUS GAME ON ANOTHER DEVICE

(71) Applicant: IGT, Las Vegas, NV (US)

(72) Inventors: Dwayne R. Nelson, Las Vegas, NV (US); Cameron A. Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/492,737

(22) Filed: Apr. 20, 2017

(65) Prior Publication Data

US 2017/0221312 A1 Aug. 3, 2017

Related U.S. Application Data

(63) Continuation of application No. 14/160,083, filed on Jan. 21, 2014, now Pat. No. 9,633,516.

(51) Int. Cl.
*G07F 17/34* (2006.01)
*G07F 17/32* (2006.01)

(52) U.S. Cl.
CPC ..... *G07F 17/3267* (2013.01); *G07F 17/323* (2013.01); *G07F 17/3218* (2013.01); *G07F 17/3262* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 5,833,537 | A | 11/1998 | Barrie | |
| 6,726,563 | B1 | 4/2004 | Baerlocher et al. | |
| 6,800,027 | B2 | 10/2004 | Giobbi et al. | |
| 6,811,486 | B1 * | 11/2004 | Luciano, Jr. ..... | G07F 17/3239 273/459 |
| 6,939,224 | B2 | 9/2005 | Palmer et al. | |
| 7,160,187 | B2 | 1/2007 | Loose et al. | |
| 7,182,690 | B2 | 2/2007 | Giobbi et al. | |
| 7,198,572 | B2 | 4/2007 | Walker et al. | |
| 7,223,172 | B2 | 5/2007 | Baerlocher et al. | |
| 7,252,590 | B2 | 8/2007 | Palmer et al. | |

(Continued)

*Primary Examiner* — Tramar Harper
(74) *Attorney, Agent, or Firm* — Neal, Gerber & Eisenberg LLP

(57) ABSTRACT

Various embodiments of the present disclosure provide a gaming system and method enabling a player to earn a play of a bonus game using one device and to redeem the earned play for an enhanced play of the bonus game on another device. Generally, various embodiments of the gaming system of the present disclosure enable a player to earn one or more plays of a bonus game through game play on a first device, and to either: (a) redeem an earned play on the first device for a play of a first version of the bonus game, or (b) redeem an earned play on a second different device for a play of a second different version of the bonus game. The second version of the bonus game is enhanced in one or more manners as compared to the first version of the bonus game.

22 Claims, 12 Drawing Sheets

(56) References Cited

U.S. PATENT DOCUMENTS 7,322,887 B2 1/2008 Belger et al.
7,607,978 B2 10/2009 Palmer et al.
7,674,180 B2 3/2010 Graham et al.
7,682,244 B1 * 3/2010 Luciano, Jr. ..... G07F 17/32 463/25
7,699,706 B2 4/2010 Walker et al.
7,708,635 B2 5/2010 Walker et al.
7,736,232 B2 6/2010 Linard et al.
7,753,770 B2 7/2010 Walker et al.
7,753,797 B2 7/2010 Walker et al.
7,775,877 B2 8/2010 Baerlocher et al.
7,785,196 B2 8/2010 Baerlocher et al.
7,789,755 B2 9/2010 Davis et al.
7,806,761 B2 10/2010 Walker et al.
7,824,258 B2 11/2010 Walker et al.
7,824,259 B2 11/2010 Walker et al.
7,846,017 B2 12/2010 Walker et al.
7,857,696 B2 12/2010 Tarantino
7,862,430 B2 1/2011 Baerlocher et al.
7,874,914 B2 1/2011 Walker et al.
7,976,372 B2 7/2011 Baerlocher et al.
7,985,133 B2 7/2011 Baerlocher et al.
7,993,195 B2 8/2011 Belger et al.
7,993,199 B2 8/2011 Iddings et al.
8,012,009 B2 9/2011 Iddings et al.
8,038,520 B2 10/2011 Walker et al.
8,038,523 B2 10/2011 Walker et al.
8,043,152 B2 10/2011 Walker et al.
8,047,908 B2 11/2011 Walker et al.
8,087,996 B2 1/2012 Walker et al.
8,092,302 B2 1/2012 Cuddy et al.
8,142,280 B2 3/2012 Walker et al.
8,152,630 B2 4/2012 Cohen
8,206,212 B2 6/2012 Iddings et al.
8,210,930 B2 7/2012 Graham et al.
8,216,062 B2 7/2012 Baerlocher et al.
8,221,226 B2 7/2012 Baerlocher et al.
8,231,458 B2 7/2012 Baerlocher et al.
8,235,812 B2 8/2012 Baerlocher et al.
8,241,108 B2 8/2012 Belger et al.
8,246,449 B2 8/2012 Baerlocher et al.
8,257,163 B2 9/2012 Belger et al.
8,262,469 B2 9/2012 Iddings et al.
8,342,958 B2 1/2013 Cuddy et al.
8,366,531 B2 2/2013 Walker et al.
8,376,836 B2 2/2013 Baerlocher et al.
8,382,572 B2 2/2013 Hoffman et al.
8,393,958 B2 3/2013 Cohen
8,425,303 B2 4/2013 Kennedy et al.
8,430,408 B2 4/2013 Baerlocher et al.
8,439,756 B2 5/2013 Baerlocher et al.
8,449,368 B2 5/2013 Walker et al.
8,454,429 B2 6/2013 Jaffe et al.
8,491,381 B2 7/2013 Nicely et al.
8,500,542 B2 8/2013 Baerlocher et al.
8,500,551 B2 8/2013 Baerlocher et al.
8,506,388 B2 8/2013 Walker et al.
8,517,818 B2 8/2013 Nicely et al.
8,550,901 B2 10/2013 Walker et al.
8,568,212 B2 10/2013 Gagner et al.
8,574,062 B2 11/2013 Giobbi et al.
8,684,828 B1 * 4/2014 Coronel ..... G07F 17/326 463/16
2001/0046893 A1 * 11/2001 Giobbi ..... G07F 17/32 463/24
2002/0094871 A1 7/2002 Luciano, Jr. et al.
2004/0266510 A1 12/2004 Kojima
2006/0094498 A1 5/2006 Jorasch et al.
2006/0105836 A1 5/2006 Walker et al.
2006/0111172 A1 5/2006 Walker et al.
2006/0211470 A1 9/2006 Walker et al.
2006/0217174 A1 9/2006 Walker et al.
2006/0287054 A1 12/2006 Walker et al.
2007/0167216 A1 7/2007 Walker et al.
2007/0275777 A1 * 11/2007 Walker ..... G07F 17/3227 463/16
2008/0032785 A1 * 2/2008 Crowder, Jr. ..... G07F 17/32 463/25
2008/0076542 A1 3/2008 Iddings et al.
2008/0113770 A1 * 5/2008 Gelber ..... G07F 17/3251 463/25
2008/0132311 A1 6/2008 Walker
2009/0111574 A1 * 4/2009 Rowe ..... G07F 17/32 463/25
2009/0131134 A1 5/2009 Baerlocher et al.
2009/0156299 A1 6/2009 Anderson et al.
2009/0170593 A1 7/2009 Pacey
2010/0081497 A1 4/2010 Wolf et al.
2010/0113122 A1 5/2010 Walker et al.
2010/0137056 A1 6/2010 Hoffman et al.
2011/0003627 A1 1/2011 Nicely et al.
2011/0263314 A1 * 10/2011 Chim ..... G07F 17/32 463/20
2011/0300922 A1 * 12/2011 Lyons ..... G07F 17/3258 463/25
2011/0306401 A1 * 12/2011 Nguyen ..... G07F 17/3244 463/20
2012/0077578 A1 3/2012 Walker et al.
2012/0214580 A1 8/2012 Hoffman et al.
2012/0270641 A1 10/2012 Baerlocher et al.
2013/0040721 A1 2/2013 Belger et al.
2013/0079110 A1 3/2013 Nicely et al.
2013/0079123 A1 3/2013 Nicely et al.
2013/0084961 A1 4/2013 Radisich et al.
2013/0095918 A1 4/2013 Cuddy et al.
2013/0116045 A1 5/2013 Baerlocher et al.
2013/0143633 A1 6/2013 Walker et al.
2013/0143645 A1 6/2013 Schaefer et al.
2013/0150152 A1 6/2013 Naglestad Cohen
2013/0172067 A1 7/2013 Hoffman et al.
2013/0203478 A1 8/2013 Kennedy et al.
2014/0370975 A1 * 12/2014 Coronel ..... A63F 13/69 463/25

* cited by examiner

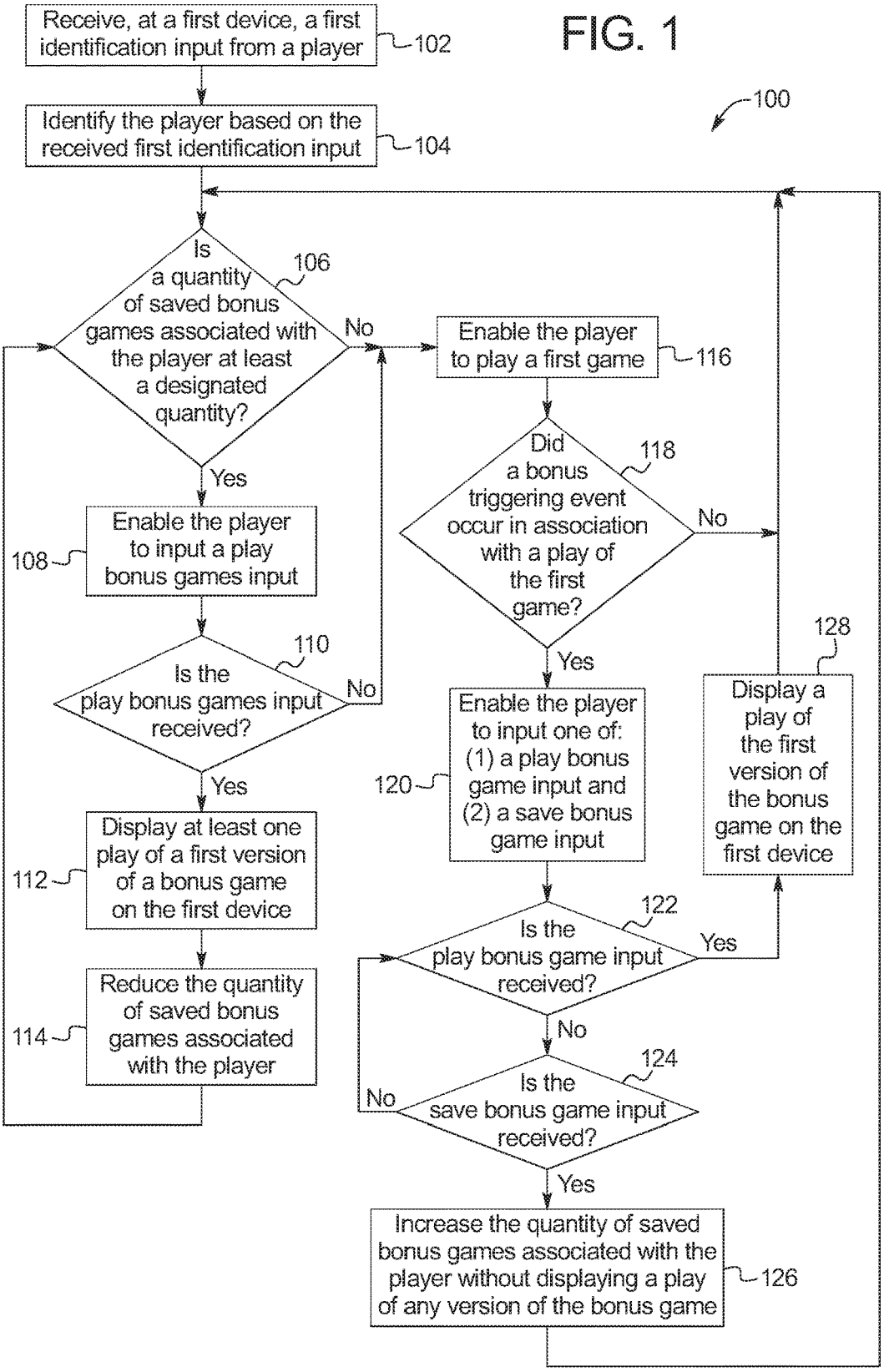
FIG. 1
100
Receive, at a first device, a first identification input from a player
102
Identify the player based on the received first identification input
104
Is a quantity of saved bonus games associated with the player at least a designated quantity?
106
No
Yes
Enable the player to input a play bonus games input
108
Is the play bonus games input received?
110
No
Yes
Display at least one play of a first version of a bonus game on the first device
112
Reduce the quantity of saved bonus games associated with the player
114
Enable the player to play a first game
116
Did a bonus triggering event occur in association with a play of the first game?
118
No
Yes
Enable the player to input one of: (1) a play bonus game input and (2) a save bonus game input
120
Display a play of the first version of the bonus game on the first device
128
Is the play bonus game input received?
122
Yes
No
Is the save bonus game input received?
124
No
Yes
Increase the quantity of saved bonus games associated with the player without displaying a play of any version of the bonus game
126

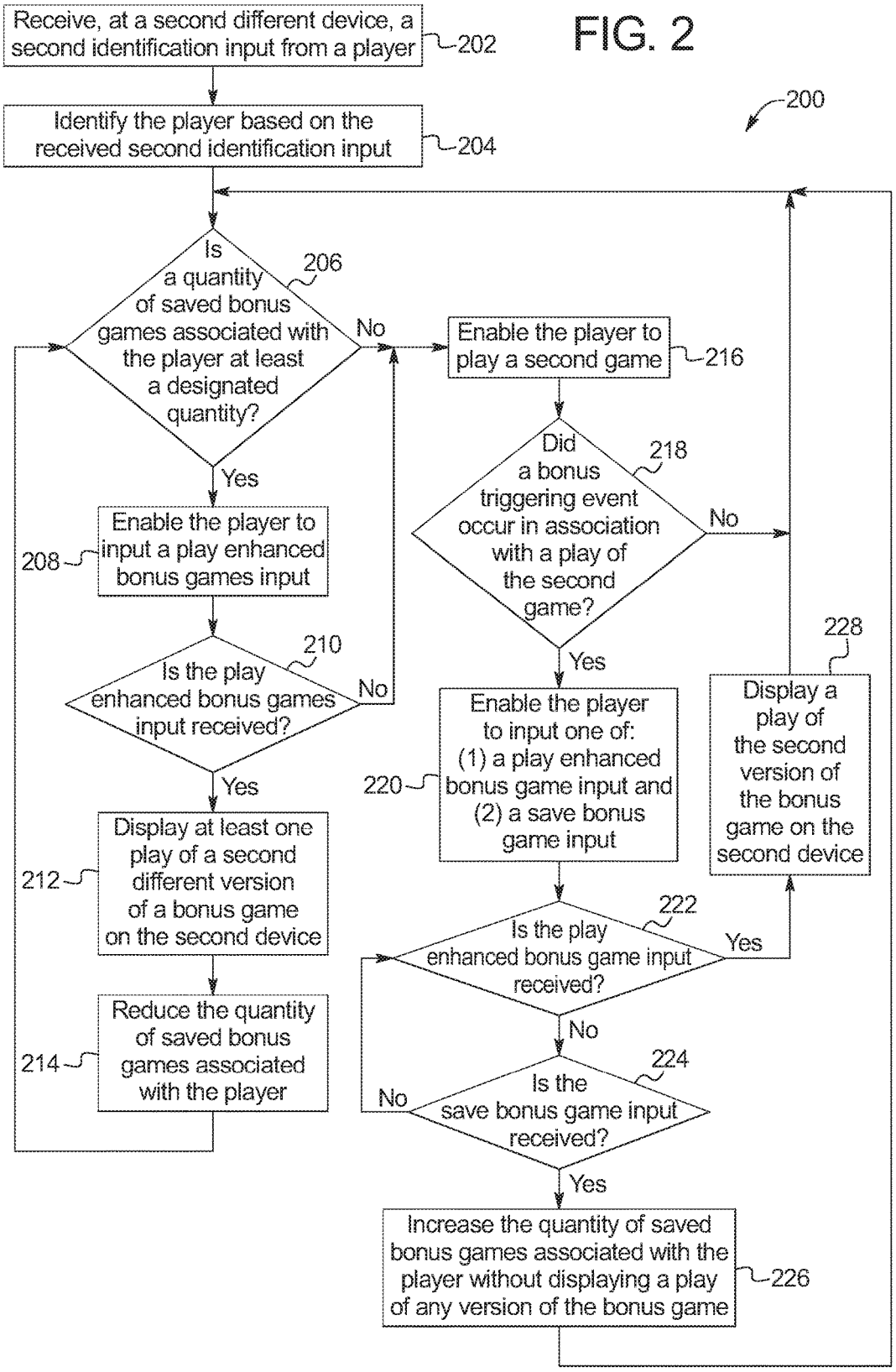
FIG. 2
200
Receive, at a second different device, a second identification input from a player
202
Identify the player based on the received second identification input
204
Is a quantity of saved bonus games associated with the player at least a designated quantity?
206
No
Yes
Enable the player to input a play enhanced bonus games input
208
Is the play enhanced bonus games input received?
210
No
Yes
Display at least one play of a second different version of a bonus game on the second device
212
Reduce the quantity of saved bonus games associated with the player
214
Enable the player to play a second game
216
Did a bonus triggering event occur in association with a play of the second game?
218
No
Yes
Enable the player to input one of: (1) a play enhanced bonus game input and (2) a save bonus game input
220
Display a play of the second version of the bonus game on the second device
228
Is the play enhanced bonus game input received?
222
Yes
No
Is the save bonus game input received?
224
No
Yes
Increase the quantity of saved bonus games associated with the player without displaying a play of any version of the bonus game
226

GAMING SYSTEM AND METHOD ENABLING A PLAYER TO EARN A PLAY OF A BONUS GAME USING ONE DEVICE AND TO REDEEM THE EARNED PLAY FOR AN ENHANCED PLAY OF THE BONUS GAME ON ANOTHER DEVICE

PRIORITY CLAIM

This patent application is a continuation of and claims priority to and the benefit of U.S. patent application Ser. No. 14/160,083, which was filed on Jan. 21, 2014, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Generally, there are three ways in which a player can engage in wager-based gaming: (1) the player can travel to a brick-and-mortar gaming establishment and play a wagering game on an electronic gaming machine (EGM) (i.e., the player can engage in land-based gaming); (2) the player can use the player's Internet-connected personal computer to access a web-based or online gaming establishment and play one or more wagering games hosted by the web-based gaming establishment (i.e., the player can engage in online gaming); and (3) the player can execute an application installed on the player's Internet- or mobile network-connected mobile device (such as a smartphone or a tablet computing device) that enables the player to play one or more wagering games hosted by a mobile gaming server (i.e., the player can engage in mobile gaming).

Each of these ways in which a player can engage in wager-based gaming has unique pros and cons. One benefit of mobile gaming is that most players who own a mobile device will carry their mobile device with them throughout the day, which makes it convenient for those players to engage in mobile gaming wherever and whenever they want (provided they have access to an Internet connection or a mobile network connection).

One downside to mobile gaming is that the graphics capabilities, sound capabilities, memory, and processing power of mobile devices are inferior to that of EGMs and personal computers. As a result, mobile wagering games typically have simple graphics, simple sound effects, and less exciting presentations than comparable wagering games played on EGMs or personal computers. Another downside to mobile gaming is that a player engaging in mobile gaming can be "on-the-go" and may be distracted and not paying complete attention to the wagering game. In other words, the player is not fully immersed in the gaming experience. Another downside is that players of mobile games often play alone and thus miss out on the social aspect of gaming (i.e., interacting with other gamers). Another downside to mobile gaming is that Internet or mobile network connections are sometimes poor, which results in slow load times or dropped signals (which are problematic for wager-based gaming). Another downside to mobile gaming is that mobile devices lack certain peripherals that enhance players' gaming experiences, such as a secondary display or "top box", a joystick, a sound chair providing surround sound and tactile feedback, and the like.

Turning to online gaming, one benefit is that the growing prevalence of Internet connections makes it easy for players to access the web-based gaming establishment at a variety of locales. Another benefit is that the graphics capabilities, sound capabilities, memory, and processing power of most personal computers is usually superior to that of mobile devices, which enables the web-based gaming establishment to offer richer content than is typically offered on mobile devices.

One downside to online gaming is that a player engaging in online gaming may be distracted and not paying complete attention to the wagering game. In other words, since the player is playing on her personal computer and may be engaging in other activities while gaming (e.g., browsing the internet, editing a document, and the like), the player is not fully immersed in the gaming experience. Another downside is that players engaging in online gaming often play alone and thus miss out on the social aspect of gaming (i.e., interacting with other gamers). Another downside to online gaming is that Internet connections are not infallible, and may be poor or susceptible to dropping, which results in slow load times or dropped signals (which are problematic for wager-based gaming). Another downside to online gaming is that personal computers lack certain peripherals that enhance players' gaming experiences, such as a secondary display or "top box", a joystick, a sound chair providing surround sound and tactile feedback, and the like.

Turning to land-based gaming, one benefit is that the graphics capabilities, sound capabilities, memory, and processing power of EGMs is typically superior to that of personal computers and mobile devices. As a result, EGMs typically provide wagering games having complex graphics and rich content. Another benefit to land-based gaming is that the typical player engaging in land-based gaming is fully immersed in the gaming experience, and may take advantage of the social aspect of gaming by interacting with other gamers. Another benefit to land-based gaming is that EGMs rarely have downtimes and are rarely out of service. Another benefit to land-based gaming is that EGMs may include a variety of peripherals that enhance players' gaming experiences, such as a secondary display or "top box", a joystick, a sound chair providing surround sound and tactile feedback, and the like.

One downside to land-based gaming is that players must travel to a gaming establishment to engage in land-based gaming.

A need thus exists for gaming systems and methods that enable players to take advantage of the accessibility of mobile gaming while also reaping the benefits of the superior technology and experience offered by land-based and online gaming.

SUMMARY

Various embodiments of the present disclosure provide a gaming system and method enabling a player to earn a play of a bonus game using one device and to redeem the earned play for an enhanced play of the bonus game on another device. Generally, various embodiments of the gaming system of the present disclosure enable a player to earn one or more plays of a bonus game through game play on a first device, and to either: (a) redeem an earned play on the first device for a play of a first version of the bonus game, or (b) redeem an earned play on a second different device for a play of a second different version of the bonus game. The second version of the bonus game is enhanced in one or more manners as compared to the first version of the bonus game.

More specifically, in operation of one embodiment, the gaming system enables a player to: (1) redeem a saved play of a bonus game on a first device (such as a mobile device configured to enable the player to engage in mobile gaming) for a play of a first version of the bonus game; (2) play a first game on the first device; (3) earn one or more plays of the bonus game through play of the first game on the first device; and (4) for each play of the bonus game earned on the first device, either: (i) redeem the earned play on the first device for a play of the first version of the bonus game, or (ii) save the earned play for later. It should be appreciated that the player may have earned each saved play redeemed on the first device through game play on the first device or through game play on a second different device (described below). Thus, in this embodiment, when the player redeems a saved play on the first device, the first device provides a play of the first version of the bonus game regardless of whether the player earned that saved play on the first device or the second device.

Additionally, the gaming system enables the player to: (1) redeem a saved play of the bonus game on the second device (such as an EGM configured to enable the player to engage in land-based gaming) for a play of a second different version of the bonus game; (2) play a second game (which may be the same as or different than the first game) on the second device; (3) earn one or more plays of the bonus game through play of the second game on the second device; and (4) for each earned play, either: (i) redeem the earned play on the second device for a play of the second version of the bonus game, or (ii) save the earned play for later. It should be appreciated that the player may have earned each saved play redeemed on the second device through game play on the first device or through game play on the second device. Thus, in this embodiment, when the player redeems a saved play on the second device, the second device provides a play of the second version of the bonus game regardless of whether the player earned that saved play on the first device or the second device.

The second version of the bonus game is enhanced in one or more manners as compared to the first version of the bonus game. This embodiment of the gaming system thus incentivizes players who earn plays of the bonus game through game play on the first device to save those earned plays and redeem those earned plays of the second device to reap the benefits of the enhancement(s) to the bonus game.

It should thus be appreciated that the certain embodiments of the gaming system and method of the present disclosure enable players to take advantage of the accessibility of mobile gaming while also reaping the benefits of the superior technology and experience offered by land-based and online gaming.

Additional features and advantages are described herein, and will be apparent from, the following Detailed Description and the Figures.

BRIEF DESCRIPTION OF THE FIGURES

FIG. 1 is a flowchart illustrating an example method of operating one embodiment of the gaming system of the present disclosure including a first device.

FIG. 2 is a flowchart illustrating an example method of operating one embodiment of the gaming system of the present disclosure including a second different device.

DETAILED DESCRIPTION

Figure 3A:
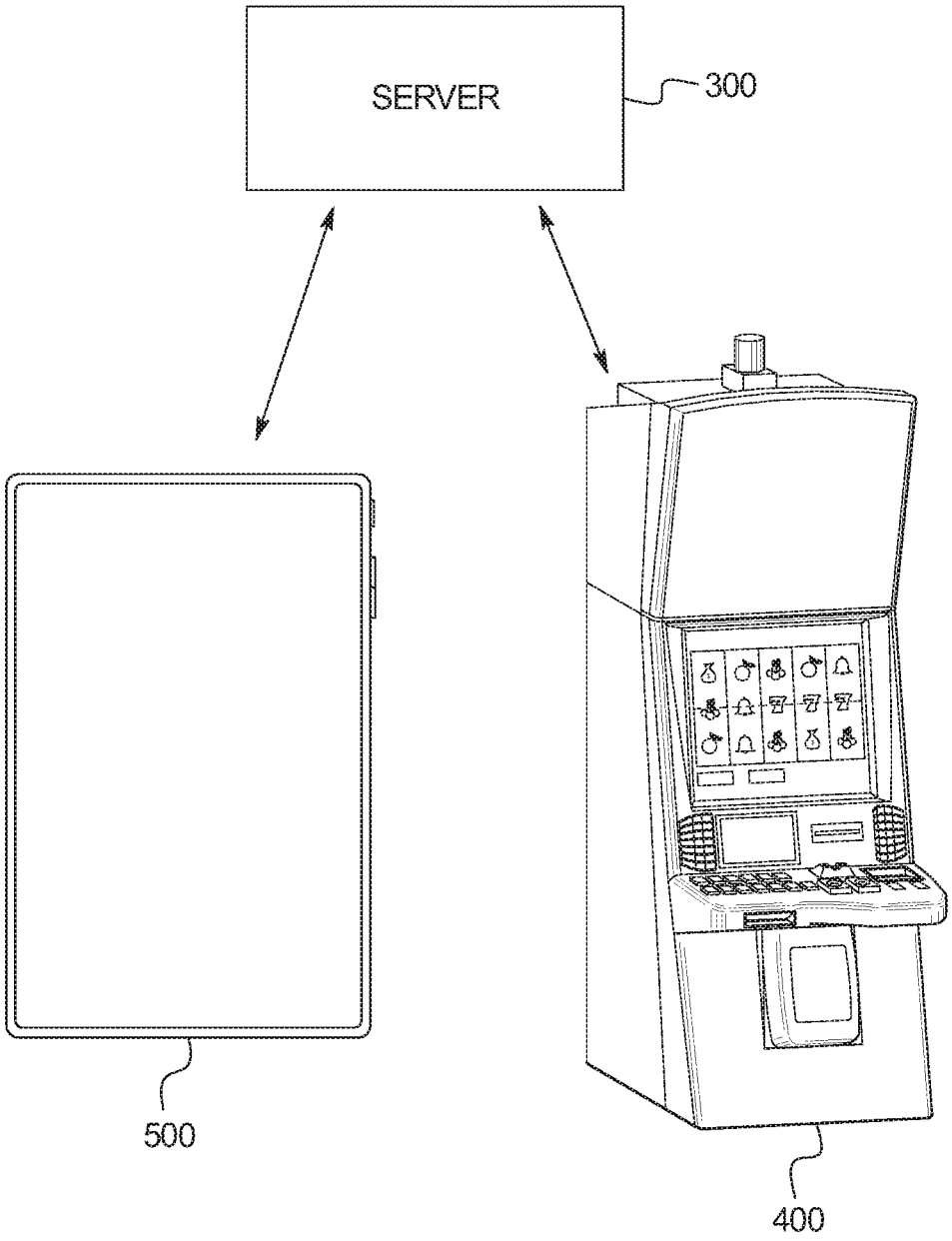
FIG. 3A is a schematic block diagram of one embodiment of the gaming system of the present disclosure including a server, an EGM, and a mobile device.

Earning a Play of a Bonus Game Using One Device and Redeeming the Earned Play for an Enhanced Play of the Bonus Game on Another Device Various embodiments of the present disclosure provide a gaming system and method enabling a player to earn a play of a bonus game using one device and to redeem the earned play for an enhanced play of the bonus game on another device. Generally, various embodiments of the gaming system of the present disclosure enable a player to earn one or more plays of a bonus game through game play on a first device, and to either: (a) redeem an earned play on the first device for a play of a first version of the bonus game, or (b) redeem an earned play on a second different device for a play of a second different version of the bonus game. The second version of the bonus game is enhanced in one or more manners as compared to the first version of the bonus game.

FIG. 1 illustrates a flowchart of an example process or method 100 of operating one embodiment of the gaming system of the present disclosure in which the gaming system enables a player to: (1) redeem a saved play of a bonus game on a first device for a play of a first version of the bonus game; (2) play a first game on the first device; (3) earn one or more plays of the bonus game through play of the first game on the first device; and (4) for each play of the bonus game earned on the first device, either: (i) redeem the earned play on the first device for a play of the first version of the bonus game, or (ii) save the earned play for later. It should be appreciated that the player may have earned each saved play redeemed on the first device through game play on the first device or through game play on a second different device (described below with respect to FIG. 2). Thus, in this example embodiment, when the player redeems a saved play on the first device, the first device provides a play of the first version of the bonus game regardless of whether the player earned that saved play on the first device or the second device.

In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the first device (such as a mobile device) receives a first identification input from the player, as indicated by block 102. It should be appreciated that the first identification input may be any suitable input that enables the gaming system to identify the player, such as (but not limited to): (a) a unique number or alphanumeric character string associated with a player tracking account or player loyalty account of the player; (b) a signal sent or emitted by one or more portable devices carried by or associated with the player, such as a radio frequency identification (RFID) tag or any other suitable device; (c) any suitable biometric input, such as a fingerprint, optical scan, or photograph of the player's face; (d) a login and password combination unique to the player; and (e) any suitable combination thereof. The gaming system determines the identity of the player based on the received first identification input, as indicated by block 104.

The gaming system determines whether a quantity of saved bonus games associated with the player is at least a designated quantity, which is one in this example embodiment (but may be any suitable quantity), as indicated by diamond 106. If the gaming system determines that the quantity of saved bonus games associated with the player is not at least the designated quantity, the process 100 proceeds to block 116, described below. If, on the other hand, the gaming system determines that the quantity of saved bonus games associated with the player is at least the designated quantity, the gaming system enables the player to input a play bonus games input, as indicated by block 108.

The gaming system determines whether the play bonus games input is received, as indicated by diamond 110. If the gaming system determines that the play bonus games input is not received, the process 100 proceeds to the block 116, described below. If, on the other hand, the gaming system determines that the play bonus games input is received, the first device displays at least one play of the first version of the bonus game, as indicated by block 112. The gaming system reduces the quantity of saved bonus games associated with the player, as indicated by block 114. The process 100 returns to the diamond 106.

Turning to the block 116, the gaming system enables the player to play a first game. The gaming system determines whether a bonus triggering event occurred in association with a play of the first game, as indicated by diamond 118. If the gaming system determines that the bonus triggering event did not occur in association with the play of the first game, the process 100 returns to the diamond 106. If, on the other hand, the gaming system determines that the bonus triggering event occurred in association with the play of the first game, the gaming system enables the player to input one of: (1) a play bonus game input, and (2) a save bonus game input, as indicated by block 120. The gaming system determines whether the play bonus game input is received, as indicated by diamond 122.

If the gaming system determines that the play bonus game input is received, the first device displays a play of the first version of the bonus game, as indicated by block 128. If, on the other hand, the gaming system determines that the play bonus game input is not received, the gaming system determines whether the save bonus game input is received, as indicated by diamond 124. If the gaming system determines that the save bonus game input is not received, the process 100 returns to the diamond 122. If, on the other hand, the gaming system determines that the save bonus game input is received, the gaming system increases the quantity of saved bonus games associated with the player without displaying a play of any version of the bonus game, as indicated by block 126. The process 100 returns to the diamond 106.

FIG. 2 illustrates a flowchart of an example process or method 200 of operating one embodiment of the gaming system of the present disclosure in which the gaming system enables a player to: (1) redeem a saved play of the bonus game on the second device for a play of a second different version of the bonus game; (2) play a second game (which may be the same as or different than the first game) on the second device; (3) earn one or more plays of the bonus game through play of the second game on the second device; and (4) for each earned play, either: (i) redeem the earned play on the second device for a play of the second version of the bonus game, or (ii) save the earned play for later. It should be appreciated that the player may have earned each saved play redeemed on the second device through game play on the first device or through game play on the second device. Thus, in this example embodiment, when the player redeems a saved play on the second device, the second device provides a play of the second version of the bonus game regardless of whether the player earned that saved play on the first device or the second device.

It should also be appreciated that the second version of the bonus game is enhanced in one or more manners as compared to the first version of the bonus game. The gaming system thus incentivizes players who earn plays of the bonus game through game play on the first device to save those earned plays and redeem those earned plays of the second device to reap the benefits of the enhancement(s) to the bonus game.

In various embodiments, the process 200 is represented by a set of instructions stored in one or more memories and executed by one or more processors. Although the process 200 is described with reference to the flowchart shown in FIG. 2, it should be appreciated that many other processes of performing the acts associated with this illustrated process 200 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the second device (such as an EGM) receives a second identification input from the player, as indicated by block 202. It should be appreciated that the second identification input may be any suitable input that enables the gaming system to identify the player, such as (but not limited to): (a) a player tracking card inserted into the EGM; (b) a unique number or alphanumeric character string associated with a player tracking account or player loyally account of the player; (c) a signal sent or emitted by one or more portable devices carried by or associated with the player, such as an RFID tag or any other suitable device; (d) any suitable biometric input, such as a fingerprint, optical scan, or photograph of the player's face; (e) a login and password combination unique to the player; and (f) any suitable combination thereof. The gaming system identifies the player based on the received second identification input, as indicated by block 204.

The gaming system determines whether a quantity of saved bonus games associated with the player is at least a designated quantity, which is one in this example embodiment (but may be any suitable quantity), as indicated by diamond 206. If the gaming system determines that the quantity of saved bonus games associated with the player is not at least the designated quantity, the process 200 proceeds to block 216, described below. If, on the other hand, the gaming system determines that the quantity of saved bonus games associated with the player is at least the designated quantity, the gaming system enables the player to input a play enhanced bonus games input, as indicated by block 208.

The gaming system determines whether the play enhanced bonus games input is received, as indicated by diamond 210. If the gaming system determines that the play enhanced bonus games input is not received, the process 200 proceeds to the block 216, described below. If, on the other hand, the gaming system determines that the play enhanced bonus games input is received, the second device displays at least one play of the second version of the bonus game, as indicated by block 212. The gaming system reduces the quantity of saved bonus games associated with the player, as indicated by block 214. The process 200 returns to the diamond 206.

Turning to the block 216, the gaming system enables the player to play a second game. The gaming system determines whether a bonus triggering event occurred in association with a play of the second game, as indicated by diamond 218. If the gaming system determines that the bonus triggering event did not occur in association with the play of the second game, the process 200 returns to the diamond 206. If, on the other hand, the gaming system determines that the bonus triggering event occurred in association with the play of the second game, the gaming system enables the player to input one of: (1) a play enhanced bonus game input, and (2) a save bonus game input, as indicated by block 220. The gaming system determines whether the play enhanced bonus game input is received, as indicated by diamond 222.

If the gaming system determines that the play enhanced bonus game input is received, the second device displays a play of the second version of the bonus game, as indicated by block 228. If, on the other hand, the gaming system determines that the play enhanced bonus game input is not received, the gaming system determines whether the save bonus game input was received, as indicated by diamond 224. If the gaming system determines that the save bonus game input is not received, the process 200 returns to the diamond 222. If, on the other hand, the gaming system determines that the save bonus game input is received, the gaming system increases the quantity of saved bonus games associated with the player without displaying a play of the any version of the bonus game, as indicated by block 226. The process 200 returns to the diamond 206.

It should be appreciated that the second version of the bonus game is enhanced as compared to the first version of the bonus game in one or manners such as (but not limited to): (a) by having better graphics as compared to the first version of the bonus game; (b) by having better sound as compared to the first version of the bonus game; (c) by having richer content as compared to the first version of the bonus game; (d) by having a more exciting presentation as compared to the first version of the bonus game; (e) by providing the player an advantage as compared to the first version of the bonus game, such as (but not limited to): (1) a higher average expected payback percentage, (2) at least one additional free spin (in a free spin bonus game), (3) at least one additional wheel spin (in a wheel spin bonus game), (4) at least one additional pick (in a pick bonus game), (5) increased award values, (6) an increased probability of winning an award, (7) an increased number of available awards, (8) eligibility for a progressive award or a jackpot award, (9) an increased rate of accumulation of player tracking points, (10) a modifier (such as a multiplier) used to modify one or more awards won during the play of the second version of the bonus game, (11) a more favorable award determination, (12) eligibility for a mystery award; (13) a free wager or wager match; and/or (14) the ability to communicate with a concierge (such as through use of a service window); (f) by providing the player one or more awards or promotions not provided via the first version of the bonus game, such as (but not limited to): (1) an award of monetary credits or currency; (2) an award of non-monetary credits or currency; (3) one or more lottery- or drawing-based awards (such as one or more lottery or drawing tickets); (4) one or more comps (such as a free dinner or a free night's stay at a hotel); (5) one or more bonus or promotional credits usable for online play; (6) one or more player tracking points; (6) a multiplier for player tracking points or credits; (7) an increase in a membership or player tracking level; (8) one or more coupons usable within a gaming establishment and/or outside of the gaming establishment (e.g., a 20% off coupon for use at a retail store or a promotional code providing a deposit match for use in association with an online casino); (9) an access code usable to unlock content on the Internet; (10) a high value product or service (such as a car); and/or (11) a low value product or service (such as a teddy bear); or (g) any suitable combination thereof.

In various embodiments, it should be appreciated that the second different version of the bonus game is identical to the first version of the bonus game aside from any enhancements applied to the second version of the bonus game. In other words, the first version and the second version of the bonus game may be a same type of game and have the same theme, but differ in that the second version of the bonus game includes one or more enhancements not included in the first version of the bonus game. For instance, in one example embodiment in which: (a) the bonus game includes ten free spins of a five reel slot game having a particular theme, and (b) the enhancement includes a 2× multiplier: (a) the first version of the bonus game includes ten free spins of the five reel slot game having that particular theme, and (b) the second different version of the bonus game includes ten free spins of the five reel slot game having that particular theme and subject to a 2× multiplier. Thus, in these embodiments, the difference between the first version of the bonus game and the second version of the bonus game is the enhancement(s) applied to the second version of the bonus game.

It should be appreciated that the first and second devices may be any suitable devices. In various embodiments: (a) the first device is a device configured to enable the player to engage in mobile gaming (such as a smart phone or a tablet computing device) and the second device is a device configured to enable the player to engage in land-based gaming (such as an EGM) or a device configured to enable the player to engage in online gaming (such as a personal computer); (b) the first device is a device configured to enable the player to engage in mobile gaming and the second device is a device configured to enable the player to engage in land-based gaming; (c) the first device is a device configured to enable the player to engage in mobile gaming and the second device is a device configured to enable the player to engage in online gaming; (d) the first device is a device configured to enable the player to engage in online gaming and the second device is a device configured to enable the player to engage in land-based gaming or a device configured to enable the player to engage in mobile gaming; (e) the first device is a device configured to enable the player to engage in online gaming and the second device is a device configured to enable the player to engage in land-based gaming; (f) the first device is a device configured to enable the player to engage in online gaming and the second device is a device configured to enable the player to engage in mobile gaming; (g) the first device is a device configured to enable the player to engage in land-based gaming and the second device is a device configured to enable the player to engage in online gaming or a device configured to enable the player to engage in mobile gaming; (h) the first device is a device configured to enable the player to engage in land-based gaming and the second device is a device configured to enable the player to engage in online gaming; and (i) the first device is a device configured to enable the player to engage in land-based gaming and the second device is a device configured to enable the player to engage in mobile gaming.

Turning to FIGS. 3A to 3F, in one example embodiment, the gaming system includes a server 300, an EGM 400 configured to enable a player to engage in land-based gaming, and a mobile device 500 configured to enable the player to engage in mobile gaming. As shown in FIG. 3A, the server 300 and the EGM 400 are configured to communicate with one another, and the server 300 and the mobile device 500 are configured to communicate with one another. Details of the server, the EGM, the mobile device, and the manner(s) in which these devices of the gaming system communicate with one another are described in detail below. It should be appreciated that while certain devices of the gaming system are described below as performing certain functions, in other embodiments any other devices of the gaming system may perform such functions alone or in combination with one or more other devices.

Generally, in this example embodiment, the gaming system enables a player to: (1) redeem a saved play of a bonus game on the mobile device 500 for a play of a first version of the bonus game; (2) play a slot game on the mobile device 500; (3) earn one or more plays of the bonus game through play of the slot game on the mobile device 500; (4) for each play of the bonus game earned on the mobile device 500, either: (i) redeem the earned play on the mobile device 500 for a play of the first version of the bonus game, or (ii) save the earned play for later; (5) redeem a saved play of the bonus game on the EGM 400 for a play of a second enhanced version (as compared to the first version) of the bonus game; (6) play the slot game on the EGM 400; (7) earn one or more plays of the bonus game through play of the slot game on the EGM 400; and (8) for each earned play, either: (i) redeem the earned play on the EGM 400 for a play of the second version of the bonus game, or (ii) save the earned play for later.

Since the second version of the bonus game is enhanced as compared to the first version of the bonus game, the gaming system incentivizes players who earn plays of the bonus game through game play on the mobile device 500 to save those earned plays and redeem them at the EGM 400 to reap the benefits of the enhancement(s) to the bonus game.

FIGS. 3B, 3C, 3D, and 3E illustrate the mobile device 500 during a play of the slot game in which the player earns a play of the bonus game. In this example embodiment, although not shown, the mobile device 500 requires the player to input a first identification input that enables the server 300 to identify the player before the mobile device 500 provides the player access to a gaming graphical user interface (GUI) (which enables the player to play the slot game and/or redeem saved bonus games). The server 300 stores (or otherwise has access to) a database (such as a player tracking database) in which each player is associated with at least one unique identification input and a quantity of saved bonus games.

In this example embodiment, after the mobile device 500 receives the first identification input from the player, the mobile device 500 sends the received first identification input (or data representing the received first identification input) to the server 300. After receiving the first identification input (or the representative data) from the mobile device 500, the server 300 cross-references the received first identification input (or the representative data) with the database and identifies: (a) the player associated with the received first identification input, and (b) the quantity of saved bonus games associated with that player. The server 300 sends this information to the mobile device 500. If the database does not include an identification input that matches or otherwise corresponds to the first identification input, the server 300 instructs the mobile device 500 to notify the player as such.

Figure 3B:
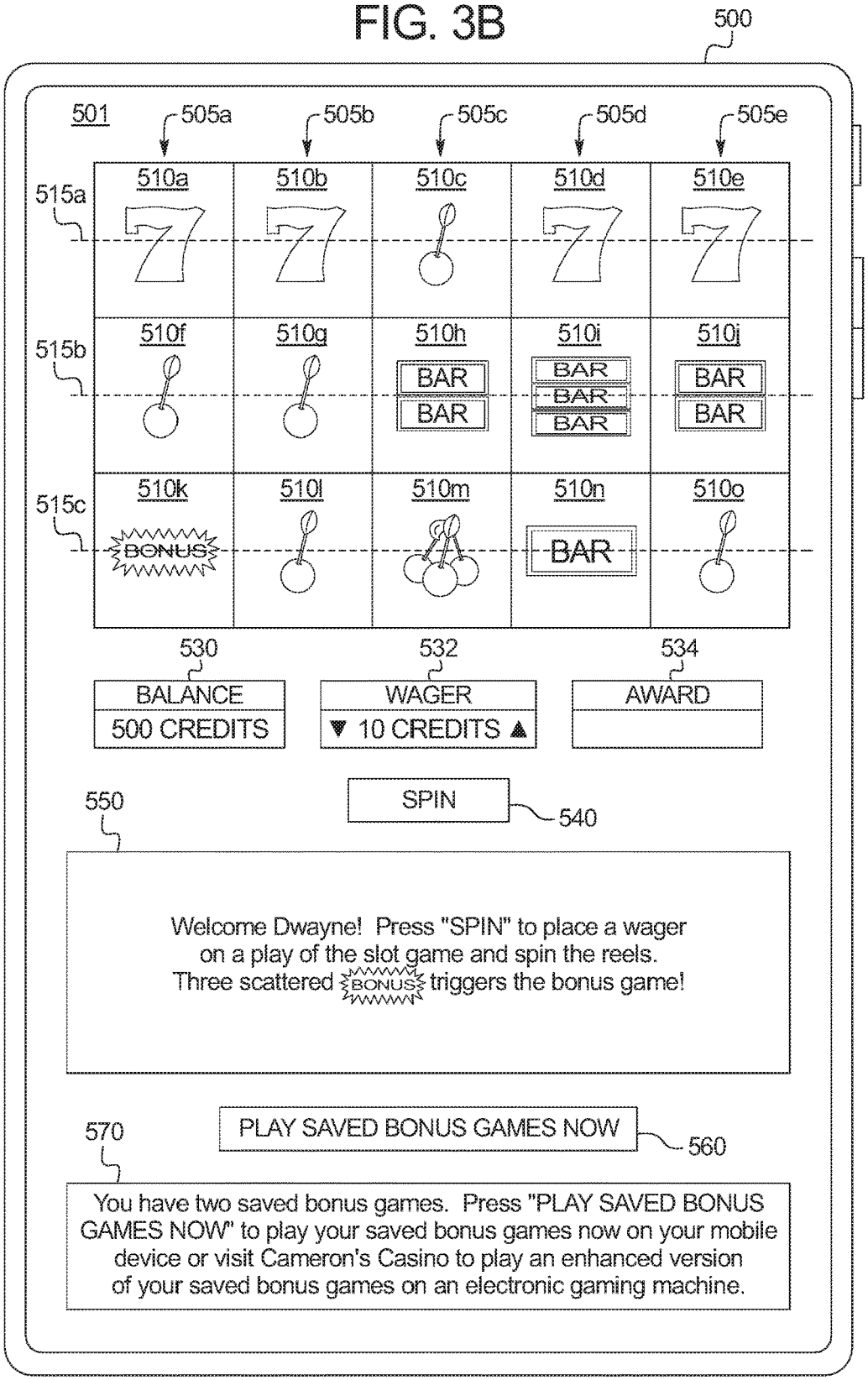
FIGS. 3B, 3C, 3D, and 3E illustrate the mobile device of FIG. 3A during a play of a slot game in which a player earns a play of a bonus game.

As shown in FIG. 3B, after the mobile device 500 receives the first identification input from the player and after the server 300 identifies the player and the quantity of saved bonus games associated with the player, the mobile device 500 displays (on a display device 501) the gaming GUI, which includes a variety of features (described below) and enables the player to play the slot game and/or redeem saved bonus games. More specifically, in this example embodiment, the mobile device 500 displays a plurality of symbol display areas 510*a*, 510*b*, 510*c*, 510*d*, 510*e*, 510*f*, 510*g*, 510*h*, 510*i*, 510*j*, 510*k*, 510*l*, 510*m*, 510*n*, and 510*o* arranged in a 3×5 grid or matrix. The mobile device 500 also displays a plurality of reels 505*a*, 505*b*, 505*c*, 505*d*, and 505*e*, each of which is associated with a plurality of a plurality of symbols the mobile device 500 employs for the slot game.

Each of the reels 505*a*, 505*b*, 505*c*, 505*d*, and 505*e* is associated with, and configured to display symbols at, a plurality of the symbol display areas. More specifically: (a) the reel 505*a* is associated with, and configured to display symbols at, the symbol display areas 510*a*, 510*f*, and 510*k*; (b) the reel 505*b* is associated with, and configured to display symbols at, the symbol display areas 510*b*, 510*g*, and 510*l*; (c) the reel 505*c* is associated with, and configured to display symbols at, the symbol display areas 510*c*, 510*h*, and 510*m*; (d) the reel 505*d* is associated with, and configured to display symbols at, the symbol display areas 510*d*, 510*i*, and 510*n*; and (e) the reel 505*e* is associated with, and configured to display symbols at, the symbol display areas 510*e*, 510*j*, and 510*o*.

The mobile device 500 displays a plurality of paylines 515*a*, 515*b*, and 515*c*, each of which is associated with a different plurality of the symbol display areas. More specifically: (a) the payline 515*a* is associated with the symbol display areas 510*a*, 510*b*, 510*c*, 510*d*, and 510*e*; (b) the payline 515*b* is associated with the symbol display areas 510*f*, 510*g*, 510*h*, 510*i*, and 510*j*; and (c) the payline 515*c* is associated with the symbol display areas 510*k*, 510*l*, 510*m*, 510*n*, and 510*o*.

The mobile device 500 also displays: (a) a plurality of meters including: (i) a credit meter 530 that displays the player's credit balance (in credit or currency form), (ii) a wager or bet meter 532 that displays any wager or bet placed on a play of the slot game (in credit or currency form), and (iii) an award meter 534 that displays any awards won for the play of the slot game (in credit or currency form); (b) a SPIN button 540 that, when actuated by the player, causes the mobile device 500 to initiate a play of the slot game; (c) a general message box 550 that displays a variety of messages or indications before, during, or after play of the slot game; (d) a PLAY SAVED BONUS GAMES NOW button 560 that, when actuated by the player, causes the mobile device 500 to enable the player to redeem at least one saved play of the bonus game for at least one play of the first version of the bonus game on the mobile device 500; and (e) a saved bonus games message box 570 that displays the quantity of saved bonus games associated with the player and that indicates how the player can redeem the player's saved bonus game(s).

As shown in FIG. 3B, the mobile device 500 displays the following message in the general message box 550 after the server 300 identifies the player: "WELCOME DWAYNE! PRESS 'SPIN' TO PLACE A WAGER ON A PLAY OF THE SLOT GAME AND SPIN THE REELS. THREE SCATTERED BONUS SYMBOLS EARNS YOU A PLAY OF THE BONUS GAME!" As also shown in FIG. 3B, the mobile device 500 displays the following message in the saved bonus games message box 570 after the server 300 identifies the player and the quantity of saved bonus games associated with the player: "YOU HAVE TWO SAVED BONUS GAMES. PRESS 'PLAY SAVED BONUS GAMES NOW' TO PLAY YOUR SAVED BONUS GAMES NOW ON YOUR MOBILE DEVICE OR VISIT CAMERON'S CASINO TO PLAY AN ENHANCED VERSION OF YOUR SAVED BONUS GAMES ON AN ELECTRONIC GAMING MACHINE!" That is, in this example embodiment, at this particular point in time, the player is associated with a quantity of two saved bonus games (which the player earned and saved during prior game play).

Since the player is associated with at least one saved bonus game, the mobile device 500 enables the player to: (a) actuate the PLAY SAVED BONUS GAMES NOW button 560 to redeem one or more of the saved bonus games associated with the player for one or more plays of the first version of the bonus game on the mobile device 500, or (b) actuate the SPIN button 540 to initiate a play of the slot game.

Figure 3C:
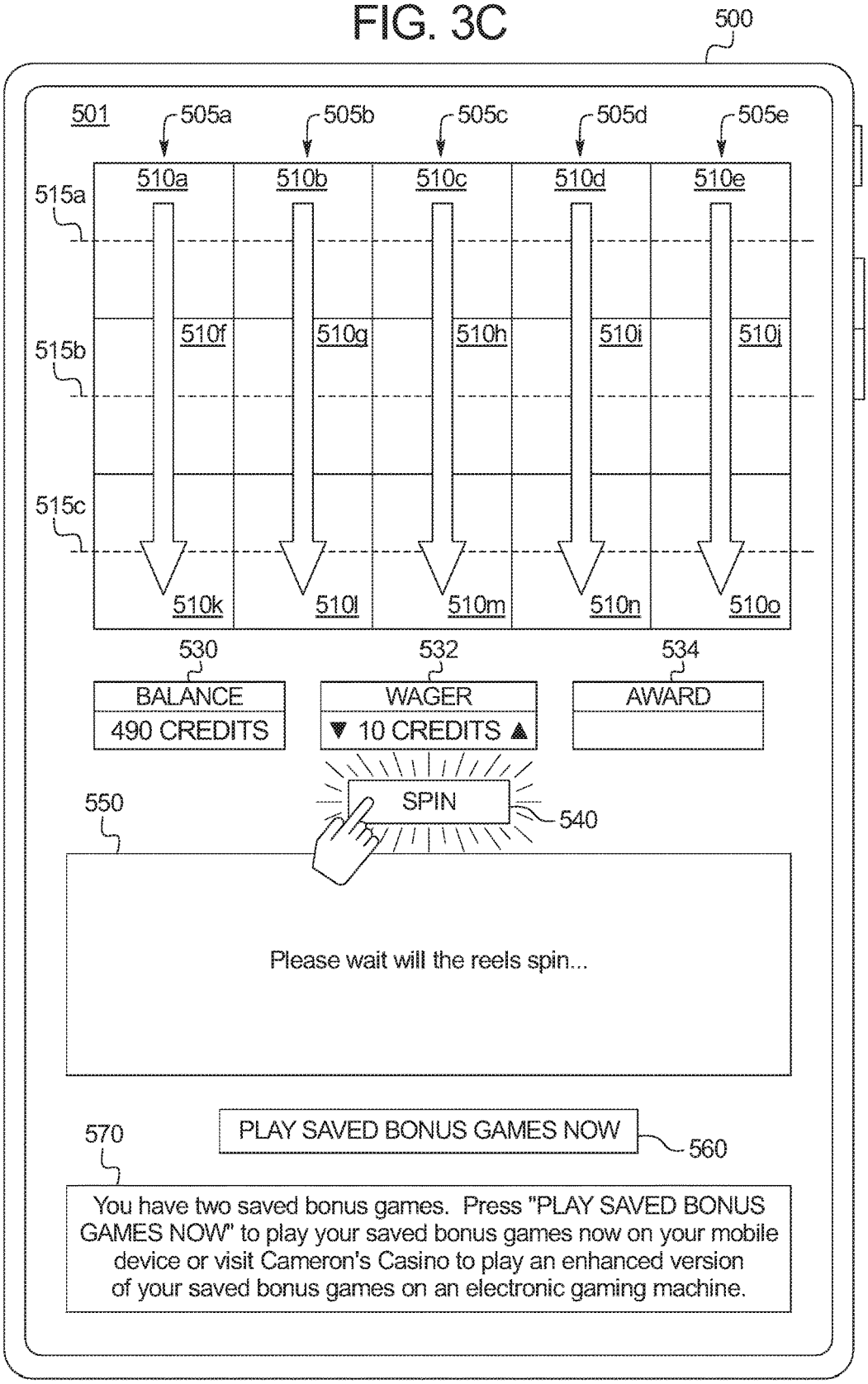

As shown in FIG. 3C, the mobile device 500 receives a wager of 10 credits from the player (as shown in the bet meter 532) and an actuation of the SPIN button 540. Upon receiving the actuation of the SPIN button 540, the mobile device 500 reduces the player's credit balance by the 10 credit wager (as shown in the credit meter 530), initiates a play of the slot game, and spins the reels 505*a*, 505*b*, 505*c*, 505*d*, and 505*e*. The mobile device 500 displays the following message in the general message box 550: "PLEASE WAIT WHILE THE REELS SPIN . . . "

Figure 3D:
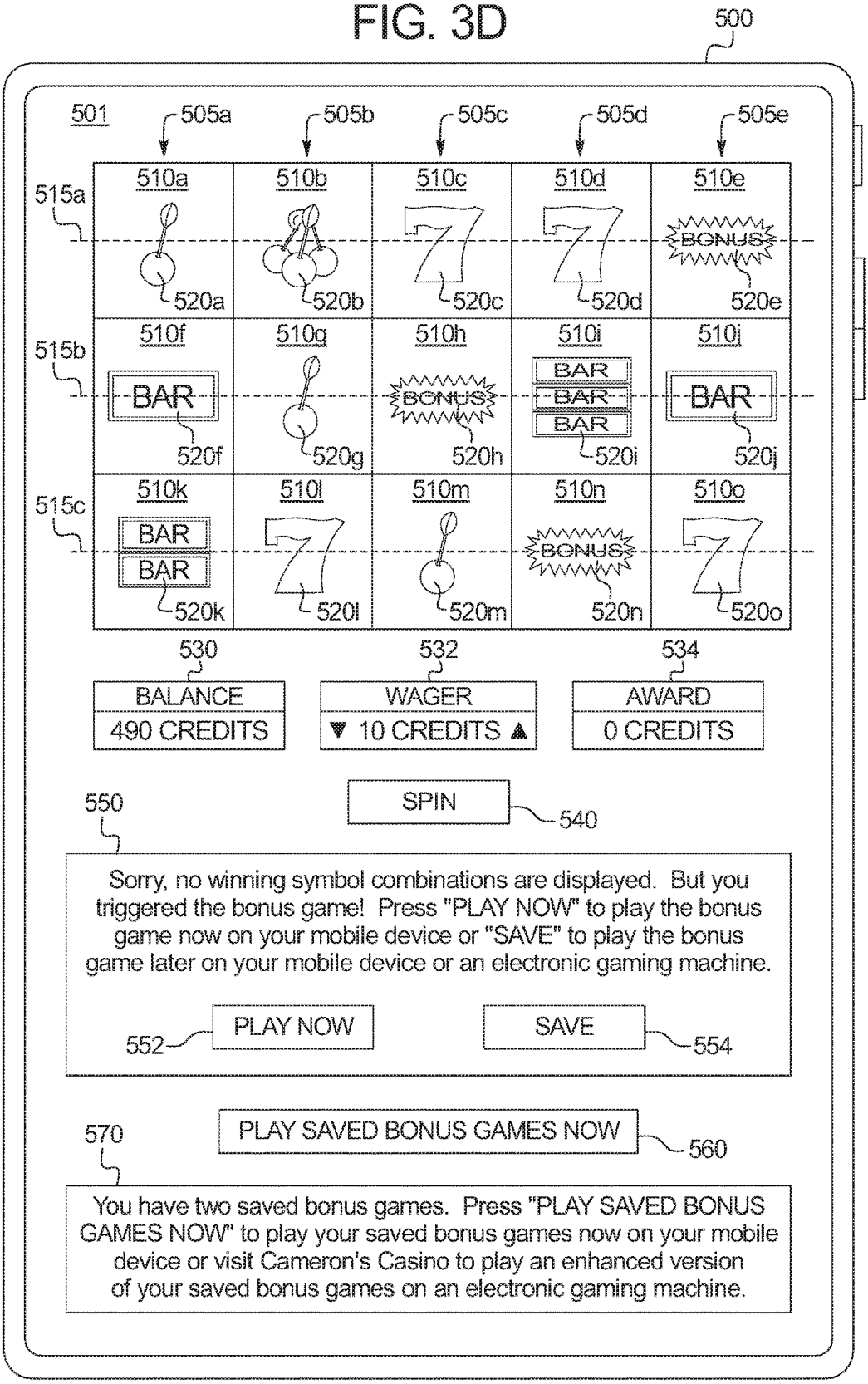

As illustrated in FIG. 3D, the mobile device 500 stops the reels 505*a*, 505*b*, 505*c*, 505*d*, and 505*e* such that: (a) Cherry symbol 520*a* is displayed at the symbol display area 510*a*, (b) Triple Cherry symbol 520*b* is displayed at the symbol display area 510*b*, (c) Seven symbol 520*c* is displayed at the symbol display area 510*c*, (d) Seven symbol 520*d* is displayed at the symbol display area 510*d*, (e) Bonus symbol 520*e* is displayed at the symbol display area 510*e*, (f) Bar symbol 520*f* is displayed at the symbol display area 510*f*, (g) Cherry symbol 520*g* is displayed at the symbol display area 510*g*, (h) Bonus symbol 520*h* is displayed at the symbol display area 510*h*, (i) Triple Bar symbol 520*i* is displayed at the symbol display area 510*i*, (j) Bar symbol 520*j* is displayed at the symbol display area 510*j*, (k) Double Bar symbol 520*k* is displayed at the symbol display area 510*k*, (l) Seven symbol 520*l* is displayed at the symbol display area 510*l*, (m) Cherry symbol 520*m* is displayed at the symbol display area 510*m*, (n) Bonus symbol 520*n* is displayed at the symbol display area 510*n*, and (o) Seven symbol 520*o* is displayed at the symbol display area 510*o*.

The gaming system determines any awards associated with the symbols displayed at the symbol display areas by determining whether any winning combinations of the symbols included in a paytable (not shown) associated with the slot game are displayed along any of the wagered-on paylines 515*a*, 515*b*, and/or 515*c*. In this example embodiment, the gaming system determines that no winning symbol combinations are displayed along any of the wagered-on paylines. The gaming system also determines whether a bonus triggering event occurred in association with the play of the slot game. In this example embodiment, the bonus triggering event occurs when three symbol display areas each display a Bonus symbol (i.e., when three Bonus symbols are displayed in a scatter configuration), though it should be appreciated that any suitable triggering event may be employed in other embodiments. Here, the gaming system determines that the bonus triggering event occurred because a Bonus symbol was displayed at each of three symbol display areas.

In this example embodiment, when the bonus triggering event occurs, the player earns one play of the bonus game and the mobile device 500 enables the player to either: (i) redeem the earned play for a play of the first version of the bonus game on the mobile device 500, or (ii) save the earned play for later. Accordingly, as shown in FIG. 3D, the mobile device 500: (a) displays a PLAY NOW button 552 and a SAVE button 554 in the general message box 550; and (b) displays the following message in the general message box 550: "SORRY, NO WINNING SYMBOL COMBINATIONS ARE DISPLAYED. BUT YOU TRIGGERED THE BONUS GAME! PRESS 'PLAY NOW' TO PLAY THE BONUS GAME NOW ON YOUR MOBILE DEVICE OR 'SAVE' TO PLAY THE BONUS GAME LATER ON YOUR MOBILE DEVICE OR AN ELECTRONIC GAMING MACHINE!"

Figure 3E:
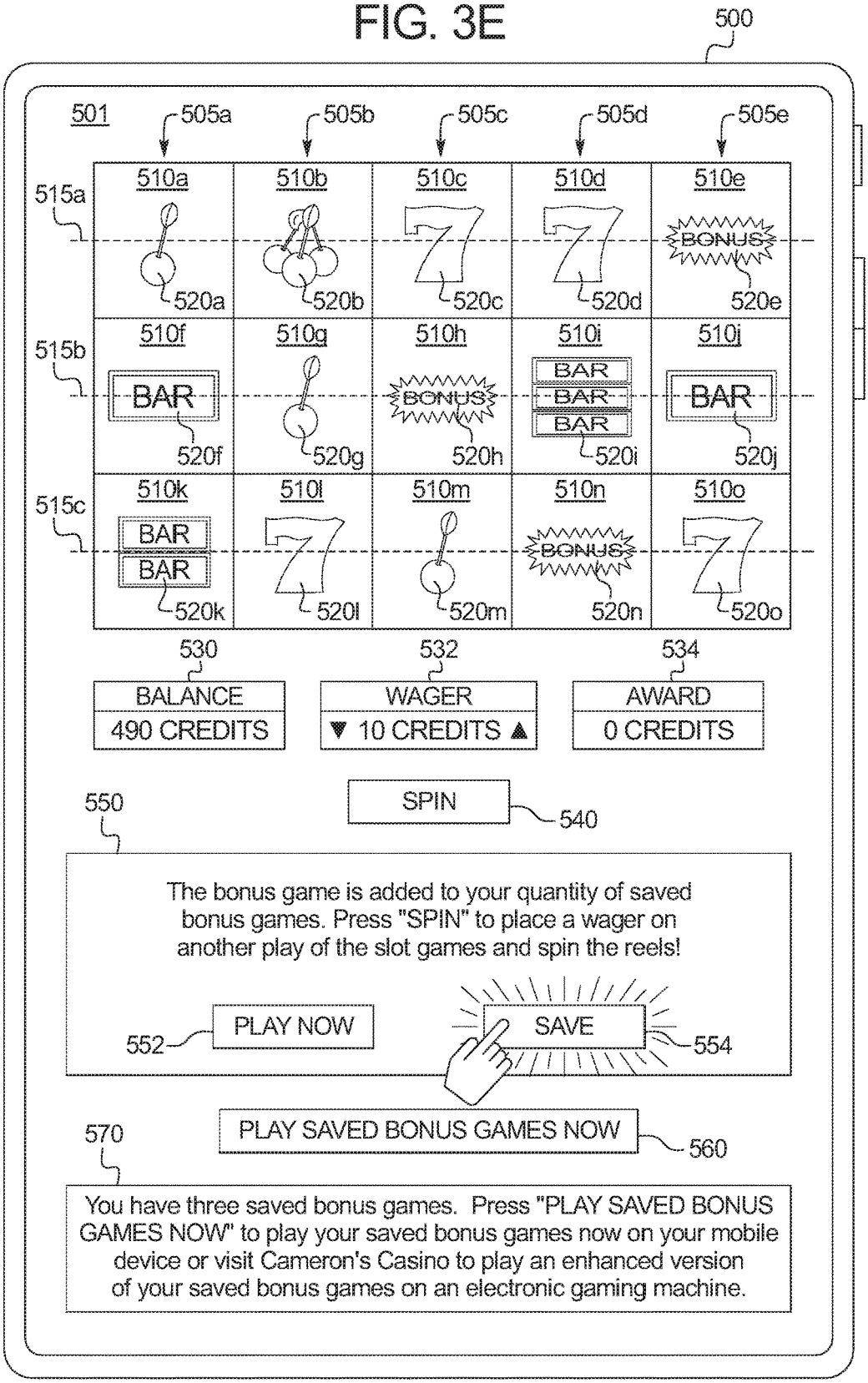

As shown in FIG. 3E, in this example embodiment, the mobile device 500 receives an actuation of the SAVE button 554 from the player. The mobile device 500 communicates to the server 300 that the player earned one play of the bonus game and decided to save that earned play of the bonus game. Accordingly, the server 300 updates the database by increasing the quantity of saved bonus games associated with the player by one. The mobile device 500 displays the following message in the general message box 550: "THE BONUS GAME IS ADDED TO YOUR QUANTITY OF SAVED BONUS GAMES. PRESS 'SPIN' TO PLACE A WAGER ON ANOTHER PLAY OF THE SLOT GAME AND SPIN THE REELS!" The mobile device 500 displays the following message in the saved bonus games message box 570: "YOU HAVE THREE SAVED BONUS GAMES. PRESS 'PLAY SAVED BONUS GAMES NOW' TO PLAY YOUR SAVED BONUS GAMES NOW ON YOUR MOBILE DEVICE OR VISIT CAMERON'S CASINO TO PLAY AN ENHANCED VERSION OF YOUR SAVED BONUS GAMES ON AN ELECTRONIC GAMING MACHINE!"

At this point, although not shown, the player logs out of the gaming GUI of the mobile device 500, visits Cameron's Casino, and sits down at the EGM 400. In this example embodiment, although not shown, the EGM 400 receives a second identification input, which is a player tracking card in this example embodiment, from the player. The EGM 400 determines and sends data based on the received second identification input to the server 300, which cross-references the received data with the database and identifies: (a) the player associated with the received second identification input, and (b) the quantity of saved bonus games associated with that player. The server 300 sends this information to the EGM 400.

Figure 3F:
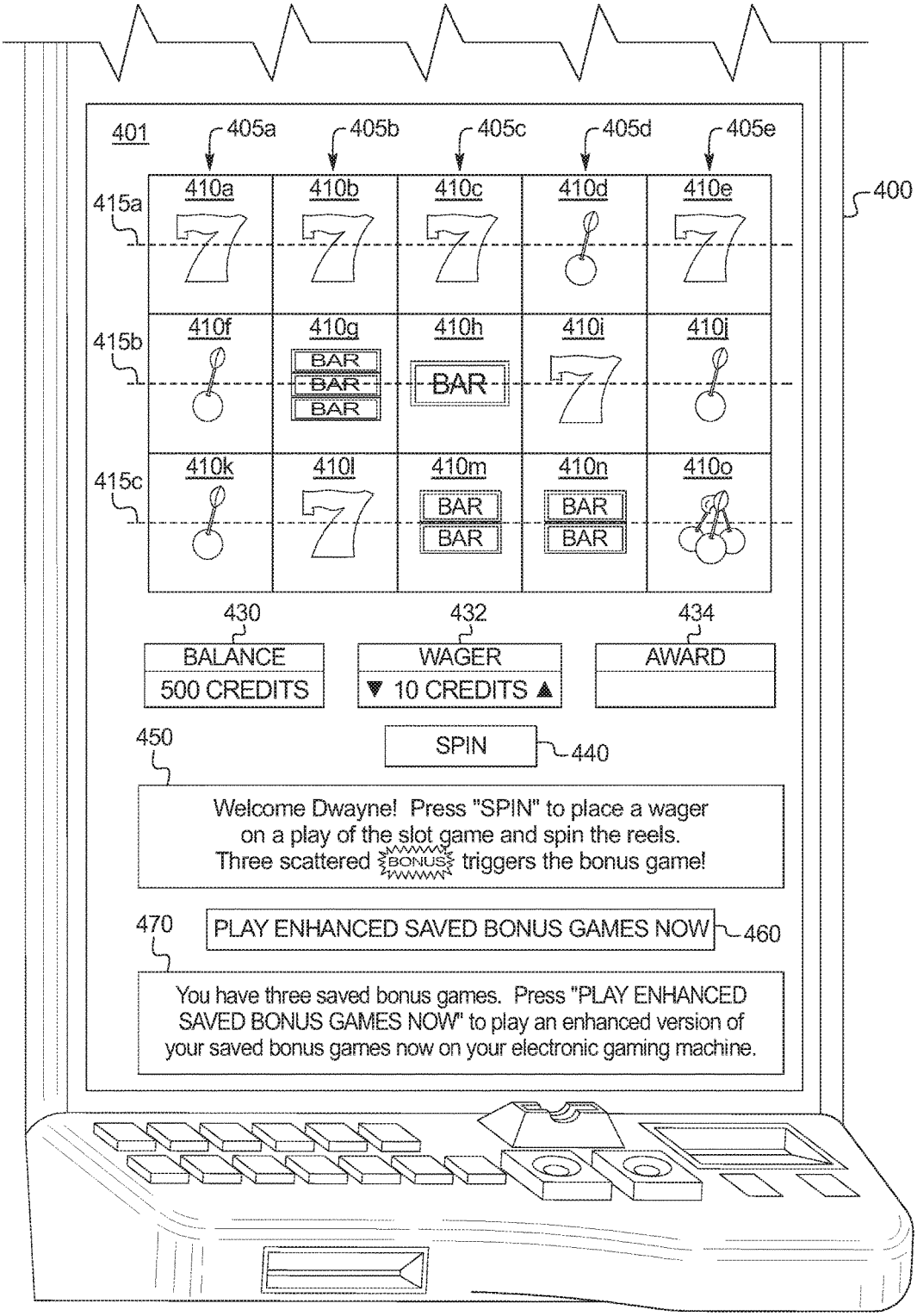
FIG. 3F illustrates the EGM of FIG. 3A after the gaming system identifies the player playing the EGM.

As shown in FIG. 3F, after the EGM 400 receives the second identification input from the player and after the server 300 identifies the player and the quantity of saved bonus games associated with the player, the EGM 400 displays (on a display device 401) a gaming GUI, which includes a variety of features (described below) and enables the player to play the slot game and/or redeem saved bonus games. More specifically, in this example embodiment, the EGM 400 displays a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, and 410*o* arranged in a 3×5 grid or matrix. The EGM 400 also displays a plurality of reels 405*a*, 405*b*, 405*c*, 405*d*, and 405*e*, each of which is associated with a plurality of a plurality of symbols the EGM 400 employs for the slot game.

Each of the reels 405*a*, 405*b*, 405*c*, 405*d*, and 405*e* is associated with, and configured to display symbols at, a plurality of the symbol display areas. More specifically: (a) the reel 405*a* is associated with, and configured to display symbols at, the symbol display areas 410*a*, 410*f*, and 410*k*; (b) the reel 405*b* is associated with, and configured to display symbols at, the symbol display areas, 410*b*, 410*g*, and 410*l*; (c) the reel 405*c* is associated with, and configured to display symbols at, the symbol display areas 410*c*, 410*h*, and 410*m*; (d) the reel 405*d* is associated with, and configured to display symbols at, the symbol display areas 410*d*, 410*i*, and 410*n*; and (e) the reel 405*e* is associated with, and configured to display symbols at, the symbol display areas 410*e*, 410*j*, and 410*o*.

The EGM 400 displays a plurality of paylines 415*a*, 415*b*, and 415*c*, each of which is associated with a different plurality of the symbol display areas. More specifically: (a) the payline 415*a* is associated with the symbol display areas 410*a*, 410*b*, 410*c*, 410*d*, and 410*e*; (b) the payline 415*b* is associated with the symbol display areas 410*f*, 410*g*, 410*h*, 410*i*, and 410*j*; and (c) the payline 415*c* is associated with the symbol display areas 410*k*, 410*l*, 410*m*, 410*n*, and 410*o*.

The EGM 400 also displays: (a) a plurality of meters including: (i) a credit meter 430 that displays the player's credit balance (in credit or currency form), (ii) a wager or bet meter 432 that displays any wager or bet placed on a play of the slot game (in credit or currency form), and (iii) an award meter 434 that displays any awards won for the play of the slot game (in credit or currency form); (b) a SPIN button 440 that, when actuated by the player, causes the EGM 400 to initiate a play of the slot game; (c) a general message box 450 that displays a variety of messages or indications before, during, or after play of the slot game; (d) a PLAY ENHANCED SAVED BONUS GAMES NOW button 460 that, when actuated by the player, causes the EGM 400 to enable the player to redeem at least one saved play of the bonus game for at least one play of the second version of the bonus game on the EGM 400; and (e) a saved bonus games message box 470 that displays the quantity of saved bonus games associated with the player and that indicates how the player can redeem the player's saved bonus game(s).

As shown in FIG. 3F, the EGM 400 displays the following message in the general message box 450 after the server 300 identifies the player: "WELCOME DWAYNE! PRESS "SPIN" TO PLACE A WAGER ON A PLAY OF THE SLOT GAME AND SPIN THE REELS. THREE SCATTERED BONUS SYMBOLS EARNS YOU A PLAY OF THE BONUS GAME!" As also shown in FIG. 3F, the EGM 400 displays the following message in the saved bonus games message box 470 after the server 300 identifies the player and the quantity of saved bonus games associated with the player: "YOU HAVE THREE SAVED BONUS GAMES. PRESS "PLAY ENHANCED SAVED BONUS GAMES NOW" TO PLAY AN ENHANCED VERSION OF YOUR SAVED BONUS GAMES NOW ON YOUR ELECTRONIC GAMING MACHINE!" That is, in this example embodiment, at this particular point in time, the player is associated with a quantity of three saved bonus games.

Since the player is associated with at least one saved bonus game, the EGM 400 enables the player to: (a) actuate the PLAY ENHANCED SAVED BONUS GAMES NOW button 460 to redeem one or more of the saved bonus games associated with the player for one or more plays of the second version of the bonus game, or (b) actuate the SPIN button 440 to initiate a play of the slot game. The EGM 400 thus enables the player to redeem saved plays earned through game play at the mobile device 500 for plays of the second (enhanced) version of the bonus game on the EGM 400.

Variations

In certain embodiments, such as the embodiment described above with respect to FIGS. 3A to 3F, when the player earns a play of the bonus game, the gaming system does not inform the player of either (a) the outcome of that play of the bonus game, or (b) any award associated with the outcome of that play of the bonus game until the player redeems that play of the bonus game. In one such embodiment, when the player earns a play of a bonus game, the server determines an outcome of that play of the bonus game and stores the determined outcome in the database. This enables the server to quickly access and cause whichever device at which the player redeems that play of the bonus game to display the previously-determined outcome of that play of the bonus game.

In other embodiments, when the player earns a play of the bonus game, the gaming system: (a) determines the outcome of that play of the bonus game (e.g., determines the reel stop positions for each spin of a free spin bonus), (b) displays the determined outcome to the player, and (c) does not display or provide any awards associated with the displayed outcome to the player until the player redeems that play of the bonus game.

In various embodiments, when the player earns a play of the bonus game, the gaming system: (a) determines the outcome of that play of the bonus game (e.g., determines the reel stop positions for each spin of a free spin bonus), (b) displays the determined outcome to the player, and (c) displays but does not provide any awards associated with the displayed outcome to the player until the player redeems that play of the bonus game.

In further embodiments, when the player earns a play of the bonus game, the gaming system: (a) determines the outcome of that play of the bonus game (e.g., determines the reel stop positions for each spin of a free spin bonus), (b) displays the determined outcome to the player, and (c) displays and provides any awards associated with the displayed outcome to the player. In other words, in these embodiments, when the player earns a play of the bonus game, the device on which the player earned the play displays the play of the bonus game. The gaming system enables the player to replay the play of the bonus game at a different device at a later point in time to enable the player to "relive" that play of the bonus game using enhancements of the different device. For instance, in one example embodiment, the second version of the bonus game offered at an EGM is enhanced as compared to the first version of the bonus game offered at a mobile device because the EGM includes superior graphics and sound capabilities. In this example embodiment, when the player earns a play of a bonus game through game play on the mobile device, the mobile device displays a play of the first version of the bonus game, and the gaming system enables the player to replay that play at the EGM at a later point in time to take advantage of the superior graphics and sound capabilities of the EGM. It should be appreciated that, in these embodiments, when the different device replays the play of the bonus game, the different device does not re-provide the award (if any) for that play of the bonus game.

In various embodiments, earned plays of a bonus game cannot be redeemed on certain devices and can only be redeemed at particular types of devices or subsets of types of devices. For instance, in one example embodiment, when a player earns a play of a bonus game through game play on a mobile device configured to enable a player to engage in mobile gaming (such as a smartphone or a tablet computing device), the gaming system does not enable the player to redeem that earned play of the bonus game on that mobile device. Instead, in this example embodiment, the gaming system enables the payer to redeem that earned play of the bonus game on a device configured to enable the player to engage in land-based gaming (such as an EGM), a device that enables the player to engage in online gaming (such as a personal computer, or either a device that enables the player to engage in land-based gaming or a device that enables the player to engage in online gaming. In another example embodiment, when a player earns a play of a bonus game through game play on a device configured to enable a player to engage in online gaming, the gaming system does not enable the player to redeem that earned play of the bonus game on that device. Instead, in this example embodiment, the gaming system enables the payer to redeem that earned play of the bonus game on a device configured to enable the player to engage in land-based gaming, a device that enables the player to engage in mobile gaming, or either a device that enables the player to engage in land-based gaming or a device that enables the player to engage in mobile gaming. In another example embodiment, when a player earns a play of a bonus game through game play on a device configured to enable a player to engage in land-based gaming, the gaming system does not enable the player to redeem that earned play of the bonus game on that device. Instead, in this example embodiment, the gaming system enables the payer to redeem that earned play of the bonus game on a device configured to enable the player to engage in online gaming, a device that enables the player to engage in mobile gaming, or either a device that enables the player to engage in online gaming or a device that enables the player to engage in mobile gaming.

In certain such embodiments, different earned plays have different redemption restrictions. For instance, in one example embodiment, earned plays of a first bonus game may be redeemed only at devices configured to enable players to engage in land-based gaming, earned plays of a second different bonus game may be redeemed only at devices configured to enable players to engage on online gaming, and earned plays of a third different bonus game may be redeemed only at devices configured to enable players to engage in mobile gaming.

In various embodiments, the gaming system need not identify the player. In one such example embodiment, when a player achieves a bonus triggering event in association with a play of a first game at a first device and inputs a save bonus game input, the first device provides the player with a unique code, such as a pin number. The gaming system enables the player to subsequently input the unique code at another device to redeem the saved bonus game or an enhanced version of the saved bonus game. In another example embodiment, when a player achieves a bonus triggering event in association with a play of a first game at a first device and inputs a save bonus game input, the first device prints or otherwise outputs a ticket including a unique barcode. The gaming system enables the player to subsequently input the ticket at another device to redeem the saved bonus game or an enhanced version of the saved bonus game. In another example embodiment, when a player achieves a bonus triggering event in association with a play of a first game at a first device and inputs a save bonus game input, the first device enables the player to input a unique key (such as a unique pin number). The gaming system enables the player to subsequently input the key at another device to redeem the saved bonus game or an enhanced version of the saved bonus game.

While the gaming system and method of the present disclosure are described with respect to plays of a bonus game, it should be appreciated that the gaming system and method of the present disclosure are applicable to any suitable event that occurs during game play, such as (but not limited to): individual plays of a primary game; "big wins" (e.g., progressive or jackpot awards); "near misses" (e.g., a player achieving four of the five symbols needed to trigger a large award); and/or communal wins.

It should be appreciated that:

(a) the designated quantity;
(b) the first game;
(c) the second game;
(d) the type of bonus game;
(e) how the second version of the bonus game is enhanced as compared to the first version of the bonus game;
(f) the combination of first and second devices;
(g) the bonus triggering event;
(h) the quantity of plays of the bonus game awarded upon the occurrence of the bonus triggering event; and/or
(i) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; (c) one or more personal computers, such as desktop computers or laptop computers; and/or (d) one or more mobile devices, such as tablet computers or computing devices, personal digital assistants (PDAs), and mobile telephones such as smart phones.

Thus, in various embodiments, the gaming system of the present disclosure includes: (a) one or more central servers, central controllers, or remote hosts; one or more EGMs; one or more personal computers; and one or more mobile devices in combination with one another; (b) one or more EGMs, one or more personal computers, and one or more mobile devices in combination with one another; (c) one or more central servers, central controllers, or remote hosts; one or more personal computers; and one or more mobile devices in combination with one another; (d) one or more central servers, central controllers, or remote hosts; one or more EGMs; and one or more mobile devices in combination with one another; (e) one or more central servers, central controllers, or remote hosts; one or more EGMs; and one or more personal computers in combination with one another; (f) one or more personal computers in combination with one or more mobile devices; (g) one or more EGMs in combination with one or more mobile devices; (h) one or more EGMs in combination with one or more personal computers; (i) one or more central servers, central controllers, or remote hosts in combination with one or more mobile devices; (j) one or more central servers, central controllers, or remote hosts in combination with one or more personal computers; (k) one or more central servers, central controllers, or remote hosts in combination with one or more EGMs; (l) one or more mobile devices in combination with one another; (m) one or more personal computers in combination with one another; (n) one or more EGMs in combination with one another; or (o) one or more central servers, central controllers, or remote hosts in combination with one another.

For brevity and clarity, each EGM, each personal computer, and each mobile device of the present disclosure is collectively referred to below as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
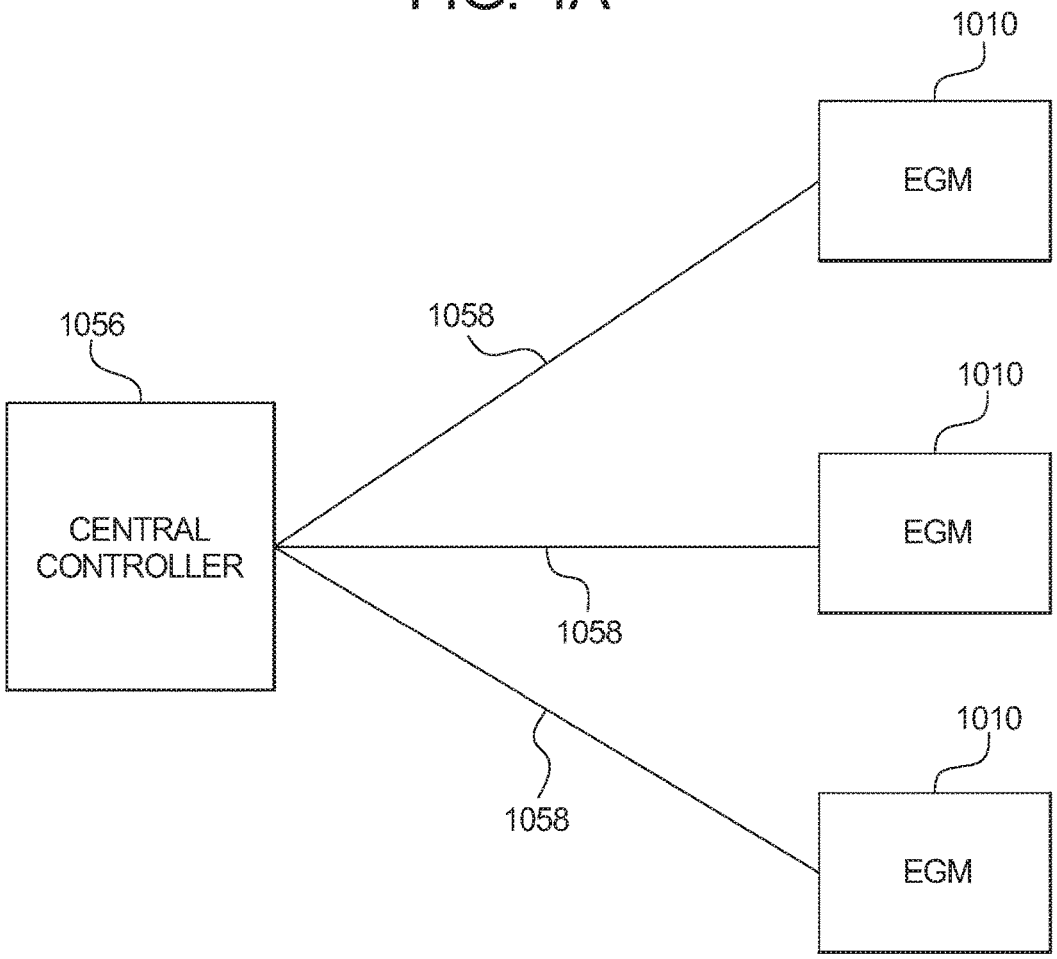
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
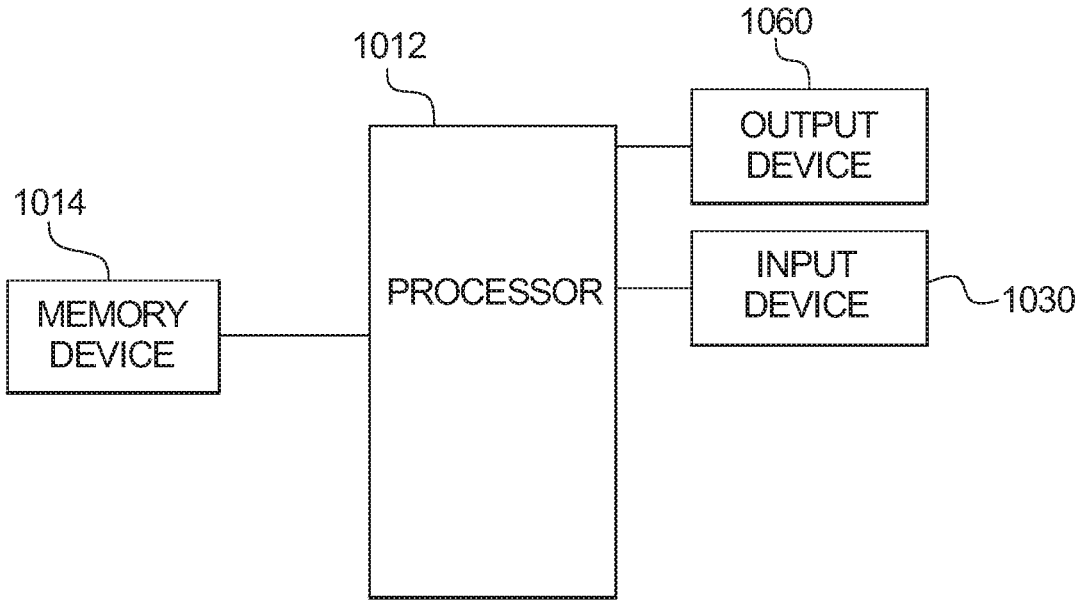
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
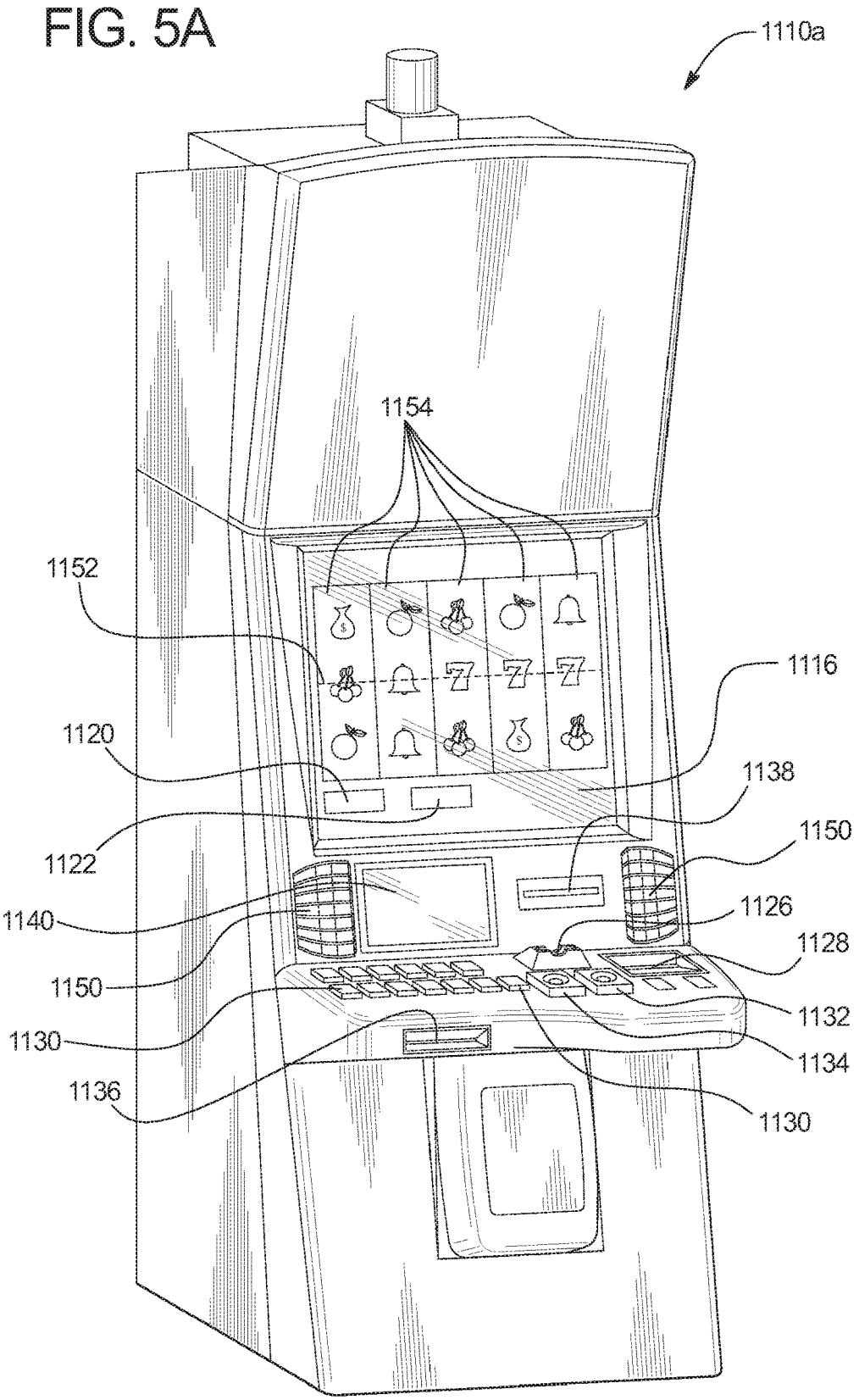
FIGS. 5A and 5B are perspective views of example alternative embodiments of the EGM of the present disclosure.
Figure 5B:
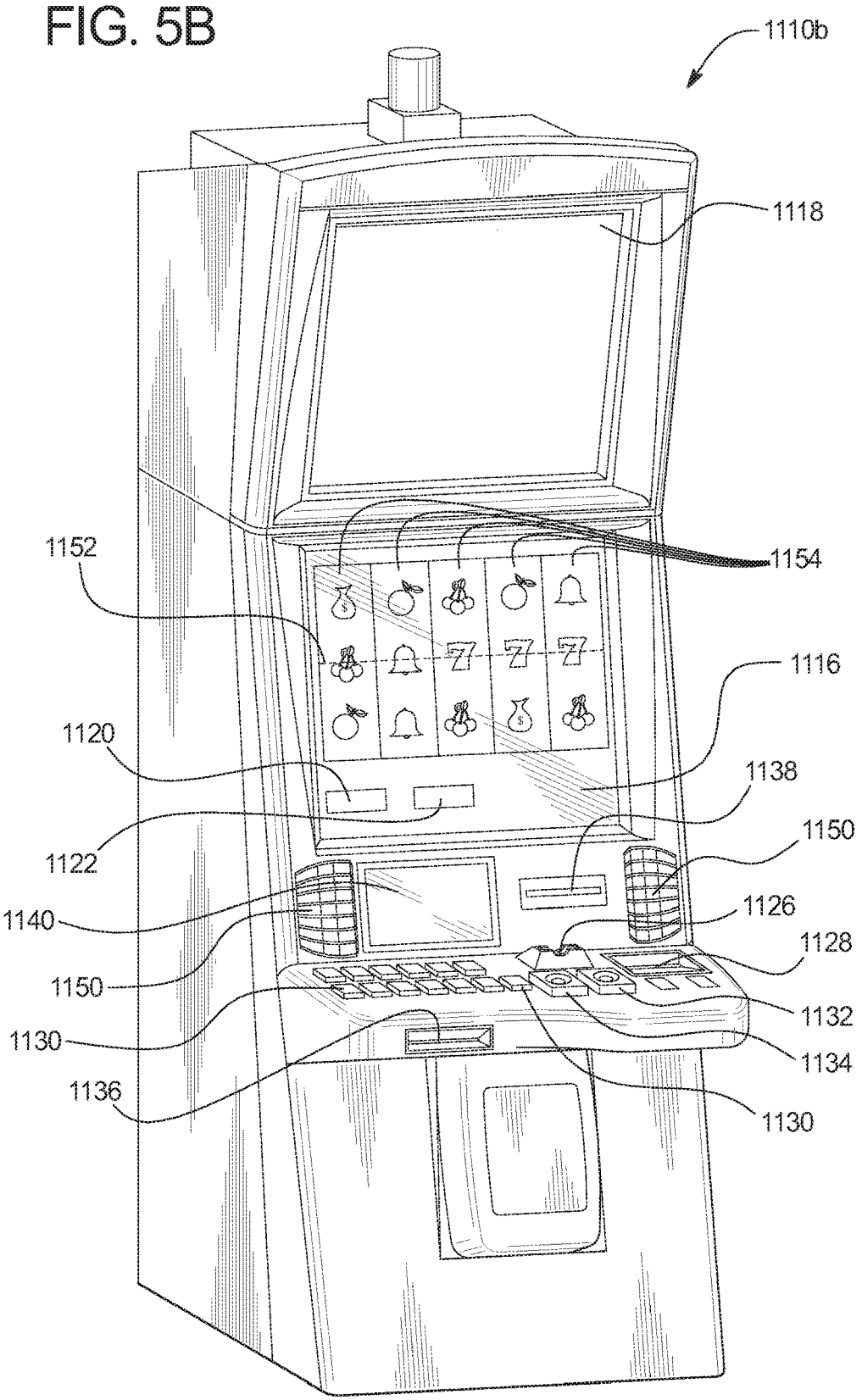

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 5A and 5B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 5A and 5B each include one or more input devices 1130.

In other embodiments, one input device of the EGM is a cash out device. The cash out device is utilized to receive a cash payment or any other suitable form of payment corresponding to a quantity of remaining credits of a credit display (as described below). The example EGMs 1110*a* and 1110*b* illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs 1110*a* and 1110*b* shown in FIGS. 5A and 5B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

a processor; and a memory device that stores instructions that, when executed by the processor, cause the processor to:

determine whether a first condition is satisfied in association with a first device configured to display a play of a first version of a bonus game;

responsive to determining that the first condition is satisfied in association with the first device, increase a quantity of saved bonus game plays without causing the first device to display any play of the first version of the bonus game and without causing the first device to display any play of an enhanced version of the same bonus game, wherein the enhanced version of the bonus game comprises a first element not in the first version of the bonus game;

determine whether a second condition is satisfied in association with a second device different from the first device;

responsive to determining that the second condition is satisfied in association with the second device, cause the second device to enable receipt of a play enhanced bonus game input, wherein receipt of the play enhanced bonus game input guarantees initiation of a play of the enhanced version of the bonus game; and responsive to receipt, by the second device, of the play enhanced bonus game input, cause the second device to display the play of the enhanced version of the bonus game.

2. The gaming system of claim 1, wherein the first version and the enhanced version of the bonus game both comprise a second element.

3. The gaming system of claim 1, wherein:

the first device comprises a mobile device; and the second device comprises a gaming machine comprising:

an acceptor configured to receive a physical item associated with a monetary value;

a display device configured to display the play of the enhanced version of the bonus game;

an input device configured to enable input of the play enhanced bonus game input;

a gaming machine processor; and a gaming machine memory device that stores gaming machine instructions that, when executed by the gaming machine processor, cause the gaming machine processor to establish a credit balance responsive to receipt of the physical item by the acceptor, the credit balance based on the monetary value associated with the physical item and increasable based on any award associated with the play of the enhanced version of the bonus game.

4. The gaming system of claim 1, wherein the first condition is satisfied when both a bonus triggering event occurs in association with a play of a game on the first device and a save bonus game input is received via the first device.

5. The gaming system of claim 1, wherein the second condition is satisfied when the quantity of saved bonus game plays is at least a designated quantity.

6. The gaming system of claim 5, wherein the instructions, when executed by the processor, cause the processor to:

determine whether the second condition is satisfied in association with the first device;

responsive to determining that the second condition is satisfied in association with the first device, cause the first device to receive input of a play bonus game input, wherein receipt of the play bonus game input guarantees initiation of the play of the first version of the bonus game; and responsive to receipt, by the first device, of the play bonus game input, cause the first device to display the play of the first version of the bonus game.

7. A gaming system comprising:

a processor; and a memory device that stores instructions that, when executed by the processor, cause the processor to:

determine whether a first condition is satisfied in association with a first device configured to display a play of a first version of a bonus game;

responsive to determining that the first condition is satisfied in association with the first device, increase a quantity of saved bonus game plays without causing the first device to display any play of the first version of the bonus game and without causing the first device to display any play of an enhanced version of the same bonus game, wherein the enhanced version of the bonus game has a greater average expected payback percentage than the first version of the bonus game;

determine whether a second condition is satisfied in association with a second device different from the first device;

responsive to determining that the second condition is satisfied in association with the second device, cause the second device to enable receipt of a play enhanced bonus game input, wherein receipt of the play enhanced bonus game input guarantees initiation of a play of the enhanced version of the bonus game; and responsive to receipt, by the second device, of the play enhanced bonus game input, cause the second device to display the play of the enhanced version of the bonus game.

8. The gaming system of claim 7, wherein:

the first device comprises a mobile device; and the second device comprises a gaming machine comprising:

an acceptor configured to receive a physical item associated with a monetary value;

a display device configured to display the play of the enhanced version of the bonus game;

an input device configured to enable input of the play enhanced bonus game input;

a gaming machine processor; and a gaming machine memory device that stores gaming machine instructions that, when executed by the gaming machine processor, cause the gaming machine processor to establish a credit balance responsive to receipt of the physical item by the acceptor, the credit balance based on the monetary value associated with the physical item and increasable based on any award associated with the play of the enhanced version of the bonus game.

9. The gaming system of claim 7, wherein the first condition is satisfied when both a bonus triggering event occurs in association with a play of a game on the first device and a save bonus game input is received via the first device.

10. The gaming system of claim 7, wherein the second condition is satisfied when the quantity of saved bonus game plays is at least a designated quantity.

11. The gaming system of claim 10, wherein the instructions, when executed by the processor, cause the processor to:

determine whether the second condition is satisfied in association with the first device;

responsive to determining that the second condition is satisfied in association with the first device, cause the first device to enable receipt of a play bonus game input, wherein receipt of the play bonus game input guarantees initiation of the play of the first version of the bonus game; and responsive to receipt, by the first device, of the play bonus game input, cause the first device to display the play of the first version of the bonus game.

12. A method of operating a gaming system, the method comprising:

determining, by a processor, whether a first condition is satisfied in association with a first device configured to display a play of a first version of a bonus game;

responsive to determining that the first condition is satisfied in association with the first device, increasing, by the processor, a quantity of saved bonus game plays without causing the first device to display any play of the first version of the bonus game and without causing the first device to display any play of an enhanced version of the same bonus game, wherein the enhanced version of the bonus game comprises a first element not in the first version of the bonus game;

determining, by the processor, whether a second condition is satisfied in association with a second device different from the first device;

responsive to determining that the second condition is satisfied in association with the second device, causing, by the processor, the second device to enable receipt of a play enhanced bonus game input, wherein receipt of the play enhanced bonus game input guarantees initiation of a play of the enhanced version of the bonus game; and responsive to receipt, by the second device, of the play enhanced bonus game input, causing, by the processor, the second device to display the play of the enhanced version of the bonus game.

13. The method of claim 12, wherein the first version and the enhanced version of the bonus game both comprise a second element.

14. The method of claim 12, wherein the first device comprises a mobile device and the second device comprises a gaming machine, the method further comprising:

receiving, by an acceptor of the gaming machine, a physical item associated with a monetary value;

establishing, by a gaming machine processor of the gaming machine, a credit balance responsive to receipt of the physical item by the acceptor, the credit balance based on the monetary value associated with the physical item and increasable based on any award associated with the play of the enhanced version of the bonus game;

causing, by the gaming machine processor, a display device to display the play of the enhanced version of the bonus game; and causing, by the gaming machine processor, an input device of the gaming machine to enable input of the play enhanced bonus game input.

15. The method of claim 12, wherein the first condition is satisfied when both a bonus triggering event occurs in association with a play of a game on the first device and a save bonus game input is received via the first device.

16. The method of claim 12, wherein the second condition is satisfied when the quantity of saved bonus game plays is at least a designated quantity.

17. The method of claim 16, further comprising:

determining, by the processor, whether the second condition is satisfied in association with the first device;

responsive to determining that the second condition is satisfied in association with the first device, causing, by the processor, the first device to enable receipt of a play bonus game input, wherein receipt of the play bonus game input guarantees initiation of the play of the first version of the bonus game; and responsive to receipt, by the first device, of the play bonus game input, causing, by the processor, the first device to display the play of the first version of the bonus game.

18. A method of operating a gaming system, the method comprising:

determining, by a processor, whether a first condition is satisfied in association with a first device configured to display a play of a first version of a bonus game;

responsive to determining that the first condition is satisfied in association with the first device, increasing, by the processor, a quantity of saved bonus game plays without causing the first device to display any play of the first version of the bonus game and without causing the first device to display any play of an enhanced version of the same bonus game, wherein the enhanced version of the bonus game has a greater average expected payback percentage than the first version of the bonus game;

determining, by the processor, whether a second condition is satisfied in association with a second device different from the first device;

responsive to determining that the second condition is satisfied in association with the second device, causing, by the processor, the second device to enable receipt of a play enhanced bonus game input, wherein receipt of the play enhanced bonus game input guarantees initiation of a play of the enhanced version of the bonus game; and responsive to receipt, by the second device, of the play enhanced bonus game input, causing, by the processor, the second device to display the play of the enhanced version of the bonus game.

19. The method of claim 18, wherein the first device comprises a mobile device and the second device comprises a gaming machine, the method further comprising:

receiving, by an acceptor of the gaming machine, a physical item associated with a monetary value;

establishing, by a gaming machine processor of the gaming machine, a credit balance responsive to receipt of the physical item by the acceptor, the credit balance based on the monetary value associated with the physical item and increasable based on any award associated with the play of the enhanced version of the bonus game;

causing, by the gaming machine processor, a display device to display the play of the enhanced version of the bonus game; and causing, by the gaming machine processor, an input device of the gaming machine to enable input of the play enhanced bonus game input.

20. The method of claim 18, wherein the first condition is satisfied when both a bonus triggering event occurs in association with a play of a game on the first device and a save bonus game input is received via the first device.

21. The method of claim 18, wherein the second condition is satisfied when the quantity of saved bonus game plays is at least a designated quantity.

22. The method of claim 21, further comprising:

determining, by the processor, whether the second condition is satisfied in association with the first device;

responsive to determining that the second condition is satisfied in association with the first device, causing, by the processor, the first device to enable receipt of a play bonus game input, wherein receipt of the play bonus game input guarantees initiation of the play of the first version of the bonus game; and responsive to receipt, by the first device, of the play bonus game input, causing, by the processor, the first device to display the play of the first version of the bonus game.

* * * * *